United States Patent [19]

Bixel et al.

[11] Patent Number: 4,828,576

[45] Date of Patent: May 9, 1989

[54] DRYING LOW RANK COAL AND RETARDING SPONTANEOUS IGNITION

[75] Inventors: John C. Bixel, Newtown, Pa.; Edward J. Bellow, Belle Mead, N.J.; William F. Heaney, Jamison, Pa.; Sandra H. Facinelli, Forest Hill, N.Y.

[73] Assignee: Mobil Oil Corporation, New York, N.Y.

[21] Appl. No.: 167,763

[22] Filed: Mar. 14, 1988

Related U.S. Application Data

[63] Continuation-in-part of Ser. No. 132,701, Dec. 10, 1981, Pat. No. 4,778,390, Ser. No. 70,649, Jul. 6, 1987, Pat. No. 4,778,482, Ser. No. 68,007, Jun. 30, 1987, Ser. No. 59,369, Jun. 8, 1987, Pat. No. 4,783,200, and Ser. No. 45,261, Apr. 20, 1987, Pat. No. 4,783,199, which is a continuation-in-part of Ser. No. 798,513, Nov. 15, 1985, abandoned, said Ser. No. 70,649, is a continuation-in-part of Ser. No. 810,116, Dec. 15, 1985, abandoned, which is a continuation-in-part of Ser. No. 798,513, , said Ser. No. 59,369, is a continuation-in-part of Ser. No. 858,621, May 1, 1986, Ser. No. 798,513, , and Ser. No. 810,116, , said Ser. No. 132,701, is a continuation-in-part of Ser. No. 858,621, , which is a continuation-in-part of Ser. No. 798,513, , and Ser. No. 810,116.

[51] Int. Cl.[4] ..... C10L 5/00; C10L 5/24

[52] U.S. Cl. ..... 44/501; 44/626

[58] Field of Search ..... 44/501, 626; 34/12

[56] References Cited

U.S. PATENT DOCUMENTS

| | | | |
|---|---|---|---|
| 4,201,657 | 5/1980 | Anderson et al. | 44/6 |
| 4,265,637 | 5/1981 | Anderson | 44/6 |
| 4,396,394 | 8/1983 | Li et al. | 44/1 |
| 4,401,436 | 7/1983 | Bonnecaze | 44/1 G |
| 4,402,707 | 9/1983 | Wunderlich | 44/6 |
| 4,421,520 | 12/1983 | Mathews | 44/6 |
| 4,498,905 | 2/1985 | Skinner | 44/501 |
| 4,501,551 | 2/1985 | Riess et al. | 44/501 |
| 4,524,227 | 6/1985 | Fowles et al. | 585/408 |
| 4,524,228 | 6/1985 | Fowles et al. | 585/408 |
| 4,524,231 | 6/1986 | Fowles et al. | 585/409 |
| 4,650,495 | 3/1987 | Yan | 44/1 G |

*Primary Examiner*—Carl F. Dees

*Attorney, Agent, or Firm*—Alexander J. McKillop; Charles J. Speciale; Van D. Harrison, Jr.

[57] ABSTRACT

Particulate coal is rendered less subject to spontaneous ignition by simultaneously spraying or otherwise contacting it and cooling it with an aqueous emulsion in water of foots oils, petrolatum filtrate, or hydrocracker recycle oils in water.

19 Claims, No Drawings

DRYING LOW RANK COAL AND RETARDING SPONTANEOUS IGNITION

Related Applications

This is a continuation in part application of the following copending applications, each of which is incorporated herein by reference: Ser. No. 045,261 filed Apr. 20, 1987 (U.S. Pat. No. 4,783,199) Ser. No. 059,369 filed June 8, 1987 (U.S. Pat. No. 4,785,200) Ser. No. 068,007 filed June 30, 1987 Ser. No. 070,649 filed July 6, 1987 (U.S. Pat. No. 4,778,482) Ser. No. 136,701 filed Dec. 10, 1987 (U.S. Pat. No. 4,778,340) application Ser. No. 045,261 is a continuation of application Ser. No. 798,513 filed Nov. 15, 1985, (now abandoned); application Ser. No. 070,649 is a continuation of Ser. No. 810,116, filed Dec. 18, 1985 (not abandoned), which is a continuation in part of Ser. No. 798,513 filed Nov. 15, 1985; application Ser. No. 059,369 is a continuation in part of Ser. No. 858,621, filed May 1, 1986, and a continuation in part of Ser. No. 798,513, filed Nov. 15, 1985, and a continuation in part of Ser. No. 810,116, filed Dec. 18, 1985, which is a continuation in part of Ser. No. 798,513, filed Nov. 15, 1985, now abandoned. Ser. No. 132,701, filed Dec. 10. 1987, is a continuation in part of Ser. No. 858.621, filed May 1, 1986 "application Ser. No. 858,621 is a continuation in part of Ser. No. 798,513, filed Nov. 15, 1985, and a continuation in part of Ser. No. 810,116, filed Dec. 18, 1985, which is a continuation in part of Ser. No. 798,513, filed Nov. 15, 1985;".

Nature of the Invention

This invention relates to improved methods for producing a dried particulate coal fuel having a reduced tendency to dust and to ignite spontaneously. More specifically, it relates to a method for drying coals, particularly low rank coals, and passivating them with an applied liquid to render them less susceptible to dusting and spontaneous ignition.

BACKGROUND OF THE INVENTION

Low rank coals, such as lignite and sub-bituminous coal are readily available. They may, however, have such high moisture contents and low heating values that they cannot be used as fuels in existing boilers without derating or significant modifications. These coals can be upgraded by thermal drying to reduce the moisture contents and heating values sufficiently that the dried coals may compete favorably with many bituminous coals. With a low sulfur content such coals can meet clean air requirements for many power plants without new flue gas desulfurization systems and make a major contribution to reducing sulfur dioxide emissions and acid rain. The drying required with such low rank coals is a deep drying process which removes both surface water and large quantities of interstitial water present. The handling, storage and transportation of such deep dried coals can present technical problems resulting from the friability and dustiness of the coals, as well as their tendencies to readsorb moisture and react with oxygen from the air. Spontaneous combustion can result from heats of moisture readsorption and oxidation. Removing moisture inherent in the coals structures can also reduce the strength of the coal particle by cracking or fissuring, causing friability and dusting. The number of active surface sites exposed within the coal particles can also thus be increased, thereby increasing undesired moisture adsorption and oxidation.

Drying conditions such as temperature, residence time within the drying chamber, drying gas velocities, etc., affect the tendencies of the dried coal product to exhibit the undesirable qualities discussed above. For example, rapid removal of moisture by a high drying temperature can cause what is commonly called "the popcorn effect"- the fissuring and cracking and disintegration of the coal particles. Drying the coal and removing the moisture at a slower rate can reduce this effect by preventing disintegration and allowing moisture to escape in a manner that reduces cracking and fissuring. Smaller fissures make the coal particles more amenable to surface treatment agents which block the pores or coat the particle surfaces and act as effective oxidation or moisture readsorption inhibitors. However, slower drying rates necessitate longer residence times in the dryness chamber to achieve the same degree of moisture removal. Because of the turbulent action in a fluidized drying bed, longer residence time leads to increased mechanical size-degradation of the coal particles, increasing dust in the dried product.

SUMMARY OF THE INVENTION

Briefly stated, this invention comprises first heating and drying particulated sub-bituminous or lignitic coal under specified conditions of temperature and residence time in the dryer. Thereafter the heated dried particulated coal simultaneously is cooled and coated by contacting it with an aqueous emulsion of a passivating agent, thereby reducing rendencies of the particulated coal to re-adsorb moisture, the dust and/or to spontaneously ignite. The passivating agent is an aqueous emulsion of a material selected from the group consisting of foots oils, petrolatum filtrate, and hydrocracker recycle oil. Of these the preferred material is petrolatum filtrate. Preferably the liquid emulsion treating agent is made up of 10 to 90 percent by weight of petrolatum filtrate, foots oils, or hydrocracker recycle oil and 90 to 10 percent by weight of water.

DETAILED DESCRIPTION OF THE INVENTION

This invention is an improved method of reducing the tendency of dried particulated coal to disintegrate and ignite spontaneously. Coals may be dried to remove the surface water or deep dried to remove interstitial water and thereby increase the heating value of the coal. In this description dried coal is coal that has been dried to remove some of the interstitial water and the moisture content of a dried coal as measured in accordance with the procedures set forth in ASTM D3173-73 entitled "Standard Test Method For Moisture in the Analysis Sample of Coal and Coke" published in the 1978 Annual Book of ASTM Standards, Part 26. Techniques for drying coal are discussed in U.S. Pat. Nos. 4,396,394 and 4,402,7078 both of which are incorporated herein by reference. The method of this invention is applicable to all forms of dried coal, especially deep dried coal, but is especially useful for dried low rank coals such as sub-bituminous, lignite and brown coals.

In the method of this invention, the coal particles are first reduced to particles having a maximum diameter of 1 to 4 inches with an average diameter of about 0.2 to 0.5 inches. The particulated coal is then contacted with a heated stream of drying gas, preferably in a fluidized bed, at a temperature between about 190° F. and 230°

F., (preferably 200° F. to 215° F.) for a contact period of between 1 and 15 minutes (preferably 3 to 7 minutes) so that the rate of evaporation of water is about 0.1 to 0.5 tons per hour (preferably 0.17 to 0.22 tons per hour) per ton of raw coal. The techniques for drying the particulated coal are set forth in the U.S. Pats. Nos. 4,396,394 and 4,402,707 noted previously. The dried particulated coal is then sprayed with the deactivating (passivating) oil composition which is an aqueous emulsion of a material selected from the group consisting of Foots oils, petrolatum filtrate, and hydrocracker recycle oil.

Accordingly, in the method of this invention after the dried coal particles have been removed from the drying system they are conveyed to a cooling zone where they are cooled and coated simultaneously by the aqueous emulsion of hydrocarbon passivating agent. The aqueous emulsion treating agent of this invention can be used in any desired quantity, but between 0.2 and 20 gallons of emulsion per ton of dried coal will ordinarily be adequate. The preferred range is between 0.5 and 2 gallons of oil per ton of dried coal.

The ratio of water to hydrocarbon in the emulsion can be between 10 to 90 parts by weight of water to 90 to 10 parts of hydrocarbon.

As for the emulsifying agent, any of those known to the prior art which will lead to the emulsification of oil in water can be used. Petroleum sulfonates can be used as emulsifiers which can be prepared separately or insitu through sulfonation of the resids or aromatic hydrocarbons. We have found the commercially available rosin and tall oil soaps such as those sold under the tradename "Unitol" to be particularly useful as the emulsifying agent in preparing emulsions of the heavier resids. The sodium soap of these two acids is most preferred. Emulsions prepared with the tall oil and rosin soaps do not invert after prolonged storage and are otherwise very stable. The amount of emulsifier to be used can best be determined experimentally for the particular composition to be used. Other emulsifiers which can be used include lignin sulfonates, dodecylbenzenesulfonate and polyoxyethylene sorbitan fatty acid esters. The emulsions can be mixed in any commercial emulsifying equipment.

Compositions and properties of some of these tall oils are as follows:

TABLE

| | Trade Name | | | |
|---|---|---|---|---|
| Description | ACD Low Rosin Tall Oil | DSR Tall Oil Fatty Acid | DT-30 Distilled Tall Oil | NCY Tall Oil Rosin |
| Composition, % | | | | |
| Fatty acid | 97.4 | 92 | 50 | 3.7 |
| Rosin acid | 0.6 | 5.2 | 33.1 | 92.4 |
| Unsaponifiables | 2 | 2.8 | 2.9 | 3.9 |
| Properties | | | | |
| Acid no. | 193 | 190 | 172 | 164 |
| Saponification No. | 195 | 192 | 178 | 172 |
| Iodine No. | 130 | 132 | — | — |
| Soften Point, °C. | — | — | — | 72 |

Polyoxyethylene sorbitan fatty acid esters such as those sold under the tradename "Tween" are also effective as the emulsifying agent.

Foots oils and petrolatum filtrate are derived from the refining of lubricant base stocks. Lubricant base stock-containing crudes are conventionally treated to atmospheric distillation followed by vacuum distillation from which the lube base stock boiling range cut is taken, solvent extracted, usually with furfural, and then solvent dewaxed, usually with methylethyl ketone or the like to produce a product which, upon filtration, is separated into a lubricant base stock and a wax. In order to further purify the wax fraction, it is subjected to conventional deoiling from which a rather hard waxy product is recovered and from which a mixture of oil and soft wax by-product is also produced. This mixture of oil and soft wax is generally referred to as foots oils. Petrolatum filtrate is also another name for similarly obtained products. These materials can be characterized as having a boiling range within the range of 650° F. to 1,100° F. and characterized as having a specific gravity at 70° C. of about 0.800 to 0.866 and a kinematic viscosity of 210° F. of about 3.8 to about 24 cs.

Hydrocracker recycle oil is the residue left from the hydrocracking of a petroleum resid which ordinarily is recycled to extinction in the process. Such a process is described in U.S. Pat. No. 3,929,617 which is incorporated herein by reference.

A preferred method of cooling the hot dried coal is to carry it to a fluidized bed wherein the fluidizing gas can be a cooling gas and the emulsion can be sprayed into the fluidized bed with the fluidizing gas. The emulsion can be used in any desired quantity, but between 0.2 and 20 gallons of liquid per ton of dried coal will ordinarily be adequate. The preferred range is between 0.5 and 2 gallons of oil per ton of dried coal.

After the particles of coal have been cooled and treated they are transported to storage for subsequent use.

What is claimed is:

1. A method of producing a dried particulate coal fuel having a reduced tendency to ignite spontaneously comprising spraying and intimately mixing said dried coal with an aqueous emulsion of a material selected from the group consisting of foots oils, petrolatum filtrate, and hydrocracker recycle oil.

2. The method of claim 1 wherein said dried particulate coal is selected from the group consisting of subbituminous, lignite, brown coals and combinations thereof.

3. The method of claim 1 wherein the aqueous emulsion also contains between about 0.0001 and about 5% by weight of emulsifying agent.

4. The method of claim 3 wherein the emulsifying agent is selected from the group consisting of soaps of tall oil, resin, petroleum sulfonates, lignin sulfonates, dodecylbenzene sulfonate, and polyoxyethylene sorbitan fatty acid esters.

5. The method of claim 1 comprising simultaneously coating the resulting heated particulate coal with an aqueous emulsion of a hydrocarbon oil and cooling the particulate coal.

6. The method of claim 1 wherein said dried coal is sprayed with between about 0.2 and about 20 gallons of aqueous emulsion per ton of coal.

7. The method of claim 1 wherein said dried coal is sprayed with between about 0.5 and about 2 gallons of aqueous emulsion oil per ton of coal.

8. The method of claim 1 wherein said deactivating composition is an emulsion of about 10 to 90 parts by weight of petrolatum filtrate in water.

9. The method of claim 1 wherein said aqueous emulsion is an emulsion of about 10 to about 90 parts by weight of foots oils in water.

10. The method of claim 1 wherein said aqueous emulsion is an emulsion of about 10 to about 90 parts by weight of hydrocracker recycle oil in water.

11. The coal product produced by the method of claim 1.

12. The coal product produced by the method of claim 2.

13. The coal product produced by the method of claim 5.

14. The coal product produced by the method of claim 6.

15. The coal product produced by the method of claim 7.

16. The coal product produced by the method of claim 8.

17. The coal product produced by the method of claim 9.

18. The coal product produced by the method of claim 10.

19. A method for passivating and cooling heated dried coal comprising simultaneously coating the hated particulate coal with an aqueous emulsion of a hydrocarbon oil and cooling the heated particulate coal in a separately removed fluidized bed.

* * * * *